US011020682B2

(12) United States Patent
Romanoff et al.

(10) Patent No.: US 11,020,682 B2
(45) Date of Patent: Jun. 1, 2021

(54) SYSTEM AND METHOD FOR CONNECTING MAGNETIC BUILDING TILES

(71) Applicant: Genius Gems, LLC, Millburn, NJ (US)

(72) Inventors: Marc Romanoff, Millburn, NJ (US); Andrew Carter, Millburn, NJ (US); Jenna Stuiso, Millburn, NJ (US)

(73) Assignee: Genius Gems, LLC, Millburn, NJ (US)

( * ) Notice: Subject to any disclaimer, the term of this patent is extended or adjusted under 35 U.S.C. 154(b) by 0 days.

(21) Appl. No.: 16/681,407

(22) Filed: Nov. 12, 2019

(65) Prior Publication Data

US 2020/0147508 A1 May 14, 2020

Related U.S. Application Data

(60) Provisional application No. 62/758,775, filed on Nov. 12, 2018.

(51) Int. Cl.

| | |
|---|---|
| ***A63H 33/04*** | (2006.01) |
| ***A63H 33/10*** | (2006.01) |
| ***A63H 33/08*** | (2006.01) |

(52) U.S. Cl.

CPC ..... *A63H 33/046* (2013.01); *A63H 33/086* (2013.01); *A63H 33/108* (2013.01)

(58) Field of Classification Search

CPC ..... A63H 33/00; A63H 33/26; A63H 33/046; A63H 33/08; A63H 33/086; A63H 3/00; A63H 3/52; A63H 33/108

USPC ..... 446/19–139

See application file for complete search history.

(56) References Cited

U.S. PATENT DOCUMENTS

| | | | | |
|---|---|---|---|---|
| 2,936,530 | A * | 5/1960 | Bowen | G09B 25/04 434/72 |
| 6,315,628 | B1 * | 11/2001 | Quercetti | A63H 33/04 446/103 |
| 6,846,216 | B1 * | 1/2005 | Balanchi | A63H 33/046 273/157 R |
| 2007/0281580 | A1 * | 12/2007 | Sambenedetto | A63H 33/08 446/124 |
| 2010/0330867 | A1 * | 12/2010 | Fogel | A63H 33/062 446/124 |

* cited by examiner

*Primary Examiner* — Kien T Nguyen

(74) *Attorney, Agent, or Firm* — Tarter Krinsky & Drogin LLP

(57) ABSTRACT

A base member configured for use with a windowed magnetic tile, the base member including a tile portion having three or more outer edges configured with respective protrusions for fitting engagement with respective notches on corresponding three or more inner edges of the windowed magnetic tile; a first projection extending outwardly from a first surface of the tile portion formed by the three or more outer edges; and a first opening disposed on the first projection.

7 Claims, 22 Drawing Sheets

100

500

500

2100

SYSTEM AND METHOD FOR CONNECTING MAGNETIC BUILDING TILES

CROSS-REFERENCE TO RELATED APPLICATION

The present application claims the benefit of and priority to U.S. Provisional Patent Application No. 62/758,775, filed on Nov. 12, 2018, the entire contents of which are incorporated by reference herein.

FIELD OF THE INVENTION

The invention relates to the field of building toys and, more specifically, to a system and method for connecting magnetic building tiles.

BACKGROUND OF THE INVENTION

Magnetic tiles are a popular building toy for children of all ages. As is known, these tiles are available in various shapes and sizes and generally have small magnets positioned around their periphery that allow them to be interconnected with other magnetic tiles. Magnetic tiles are widely used to foster the development of science, technology, engineering and mathematics (STEM) skills in children. For example, they can be used to teach geometry, as well as design and construction techniques.

However, there are limitations on the types of structures that can be built using magnetic tiles due, in large part, to their magnetic connection systems. Even high-quality magnetic tiles, which have relatively strong magnets, cannot support significant weight and are easily separated during play. As such, users, particularly younger children, may find building with magnetic tiles frustrating. Moreover, even older children and adults may wish to build structures with magnetic tiles that have increased structural rigidity.

As such, there is a need for a new system and method for connecting magnetic building tiles. Such a system and method would be particularly useful if it provided increased structural rigidity to projects constructed using magnetic building tiles.

SUMMARY OF THE INVENTION

The invention relates to a system and method for connecting magnetic building tiles. The system may include: magnetic building tiles that have open center portions (commonly referred to as window tiles), base members that snap into the window tiles, and a variety of connector elements that connect the tiles to one another. The system may further include bearing and wheels for constructing vehicles and other rotating structures.

DETAILED DESCRIPTION OF THE INVENTION

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 9A:
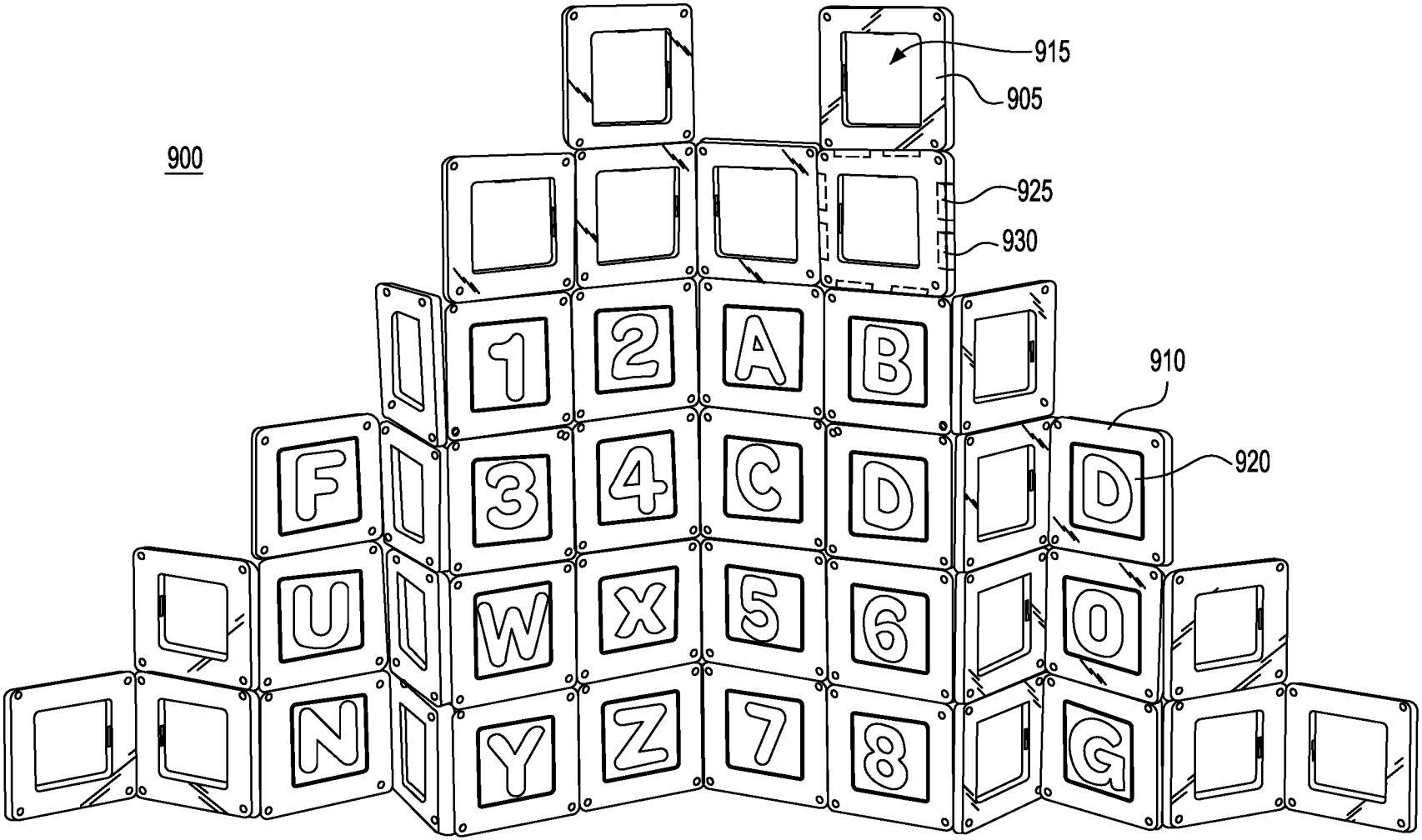
RELATED ART FIG. 9A
FIG. 9A is a photograph of a prior art magnetic building set.
Figure 9B:
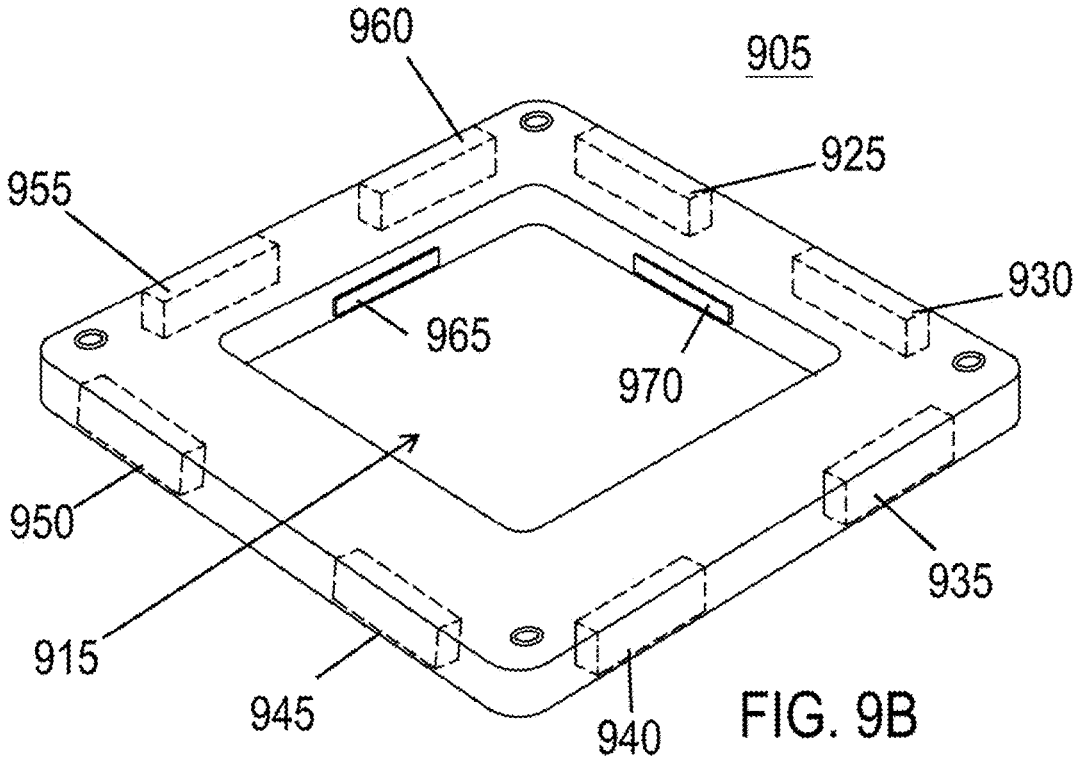
FIG. 9B is an illustration of a windowed magnetic tile for use with a base member according to an exemplary embodiment of the present invention.

Shown in FIG. 9A is a known magnetic tile building set 900 sold under the PLAYMAGS™ brand. As can be seen in FIG. 9B, each tile in this particular set 900 is a window tile (905 and 910), i.e., it has a square opening 915 in its center. Letters, numbers, and other mathematic operators (e.g. "D" 920) can be snapped into the center portion of the tiles (e.g. 910). However, as discussed, such building systems rely solely upon the strength of the small magnets (e.g., 925, 930, 935, 940, 945, 950, 955, and 960) positioned around the perimeter of the tiles (generally two magnets on each side, e.g., 925, 930, 935, 940, 945, 950, 955, and 960) to maintain the connection between tiles.

Figure 1:
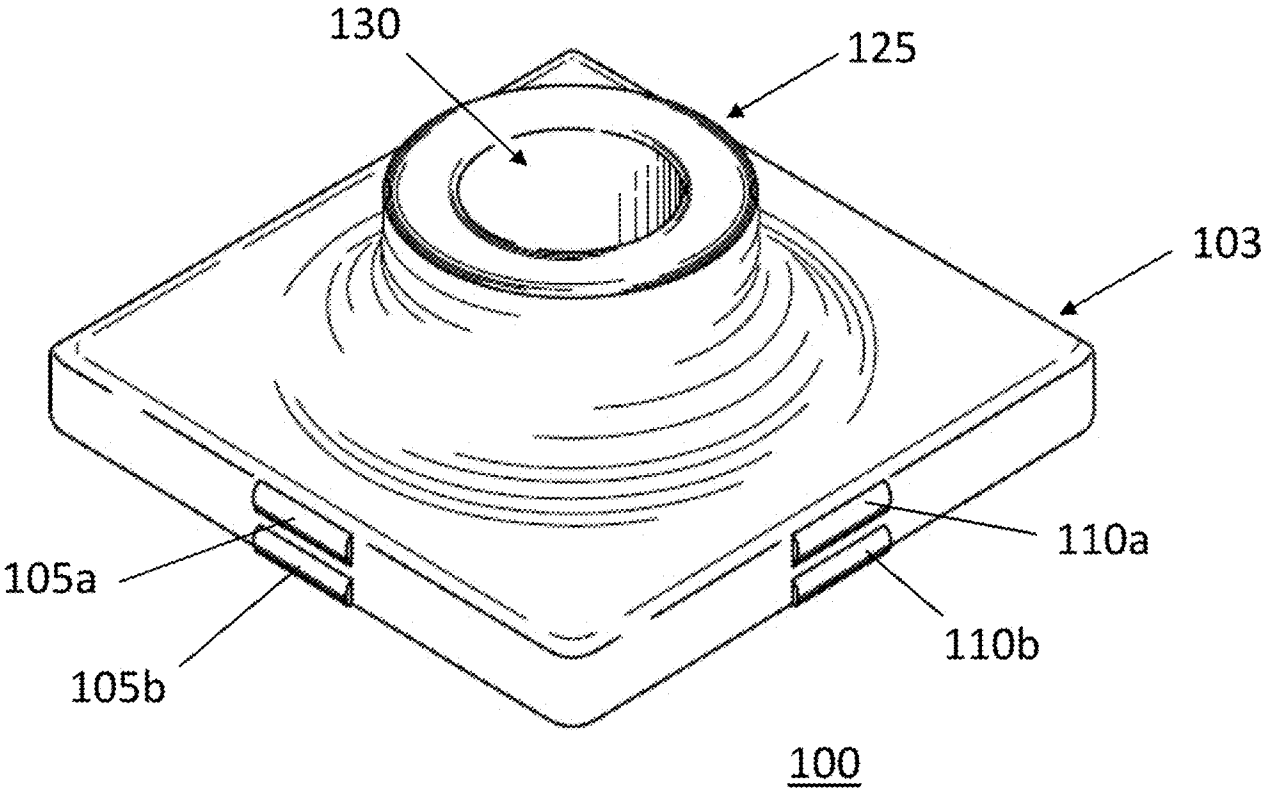
FIGS. 1-4 are illustrations of an embodiment of a base member for use with the disclosed system and method.
Figure 2:
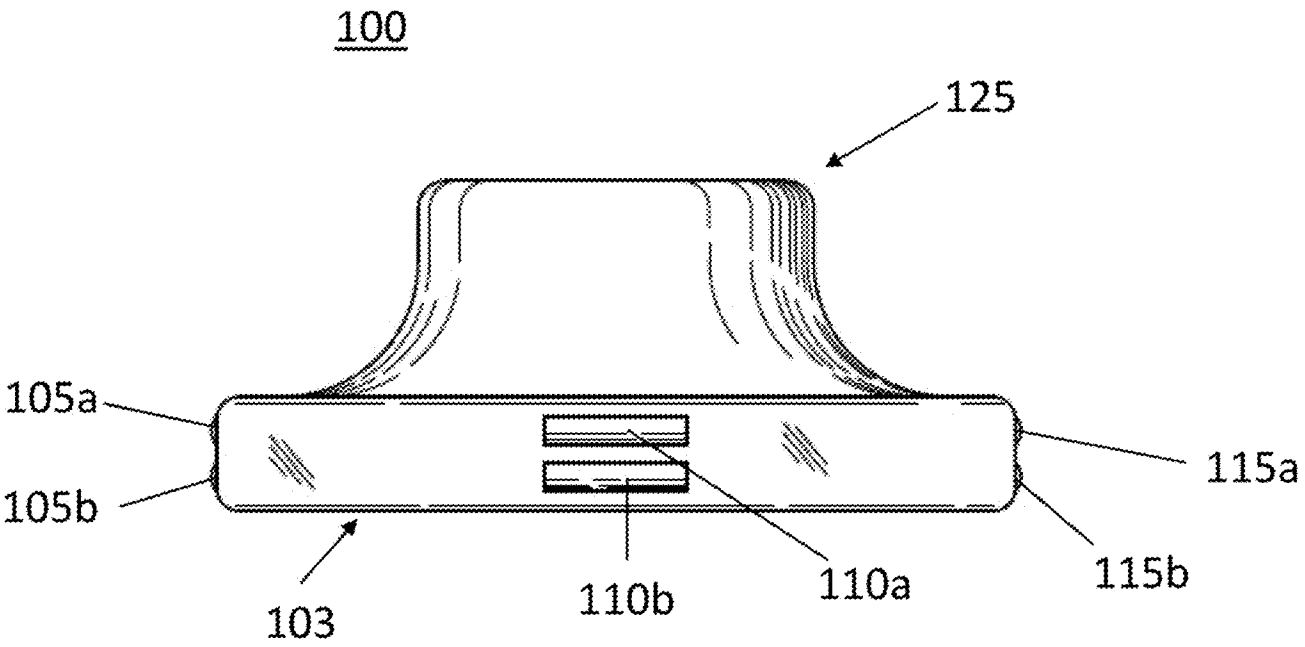
Figure 3:
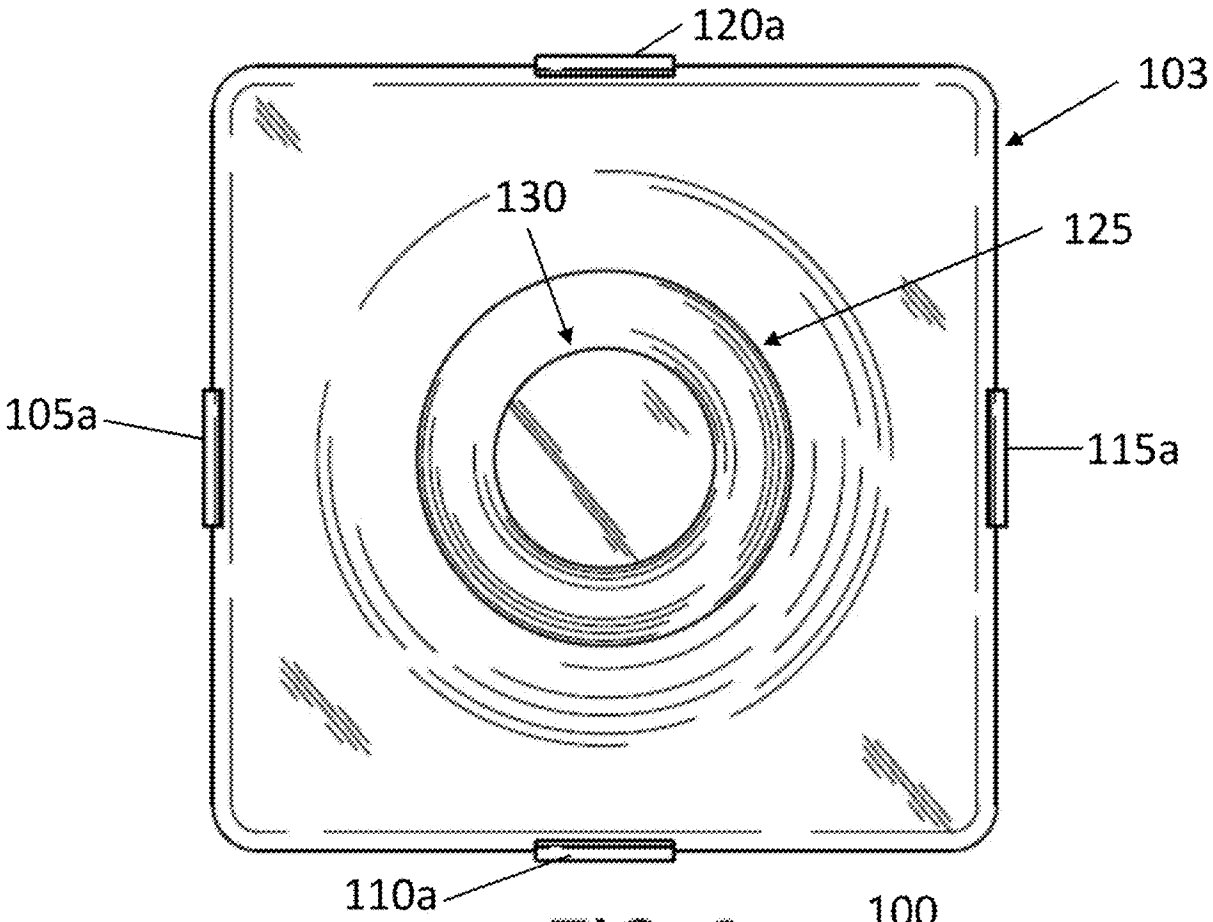
Figure 4:
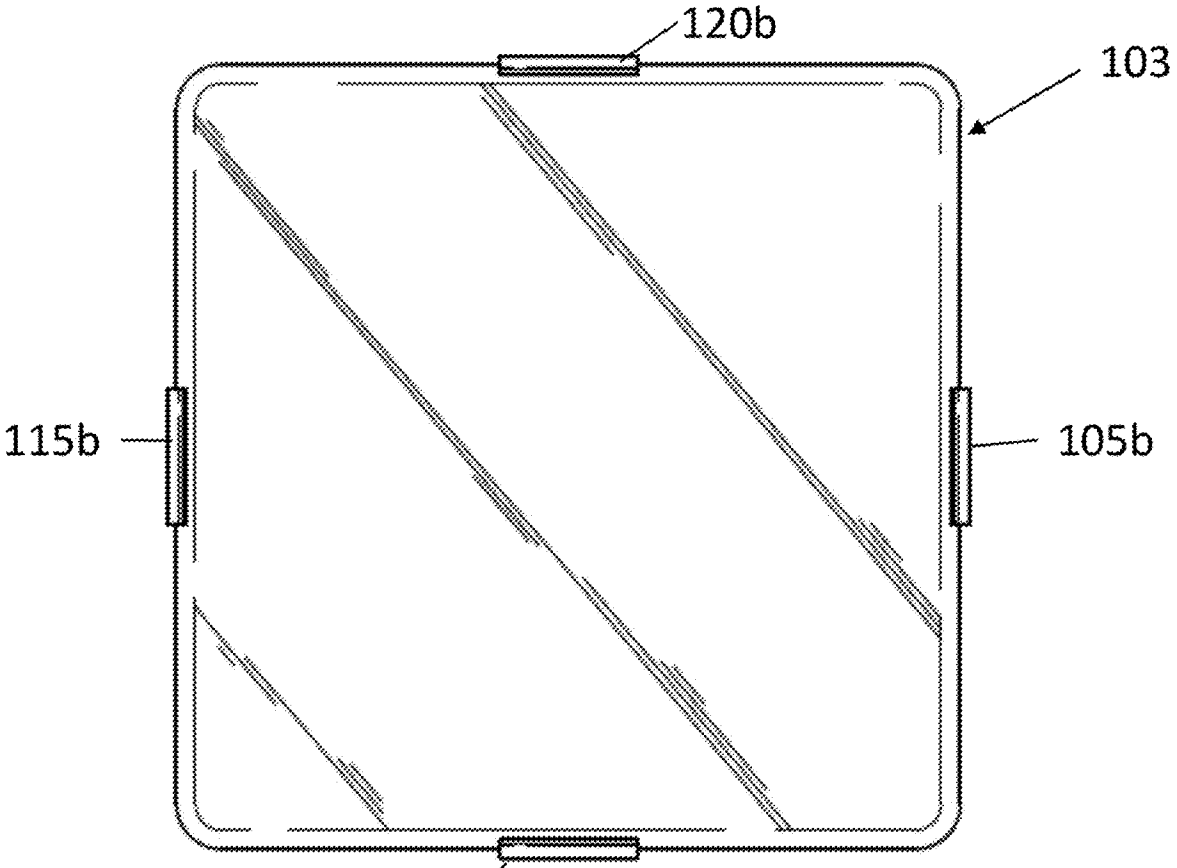
Figure 9C:
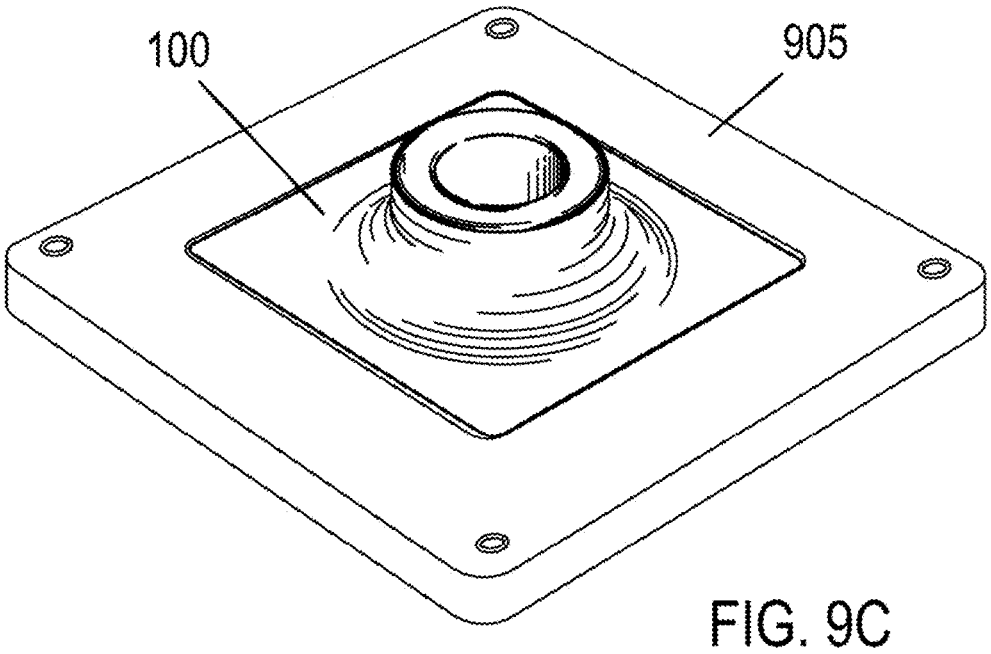
FIG. 9C is a diagram showing a base member incorporated with the windowed magnetic tile of FIG. 9B according to an exemplary embodiment of the present invention.

Shown in FIGS. 1-4 is a base member 100 according to an exemplary embodiment of the present invention. FIG. 1 is a perspective view, FIG. 2 is a front view, FIG. 3 is a top view, and FIG. 4 is a bottom view of a base member 100 according to an exemplary embodiment of the present invention. As illustrated in FIG. 9C, the base member 100 is configured to snap into a magnetic window tile, such as square opening 915 of tile 905 shown in FIG. 9B. In this embodiment, as illustrated in FIGS. 1-4, the base member 100 includes a square tile portion 103 that is dimensioned to fit and that would be held in position in square opening 915 of tile 905 by elongated protrusions 105*a*, 105*b*, 110*a*, 110*b*, 115*a*, 115*b*, 120*a*, and 120*b*, two (2) of which are located on each of the four edges of the square tile portion 103 of the base member 100. According to an exemplary embodiment and as shown in FIGS. 1-4, the protrusions 105*a*, 105*b*, 110*a*, 110*b*, 115*a*, 115*b*, 120*a*, and 120*b* are positioned at the centers along the respective edges of the square tile portion 103 of base 100 and are dimensioned to fit with corresponding notches (e.g., 965 and 970 illustrated in FIG. 9B) in square opening 915 of tile 905 so that base member 100 is held in place while being removable from tile 905 without requiring excessive force. According to other embodiments, base member 100 may also have a tile portion corresponding to square tile portion 103 with a different shape—such as a triangle, pentagon, hexagon, octagon, and the like—for fitting in magnetic tiles having openings with such corresponding shapes.

As shown in FIGS. 1-3, base member 100 has a volcano-shaped projection 125 extending from one of its faces that, as discussed further below, is configured—e.g., with a central opening 130—to accept various connector elements and facilitate interconnection of other tiles. In embodiments, square tile portion 103 may be made from a rigid (e.g., polymeric) material and the volcanic-shaped projection 125 may be made from a semi-resilient or resilient (e.g., polymeric) material for ease of inserting and removing the connector elements, as described in further detail below.

Figure 5:
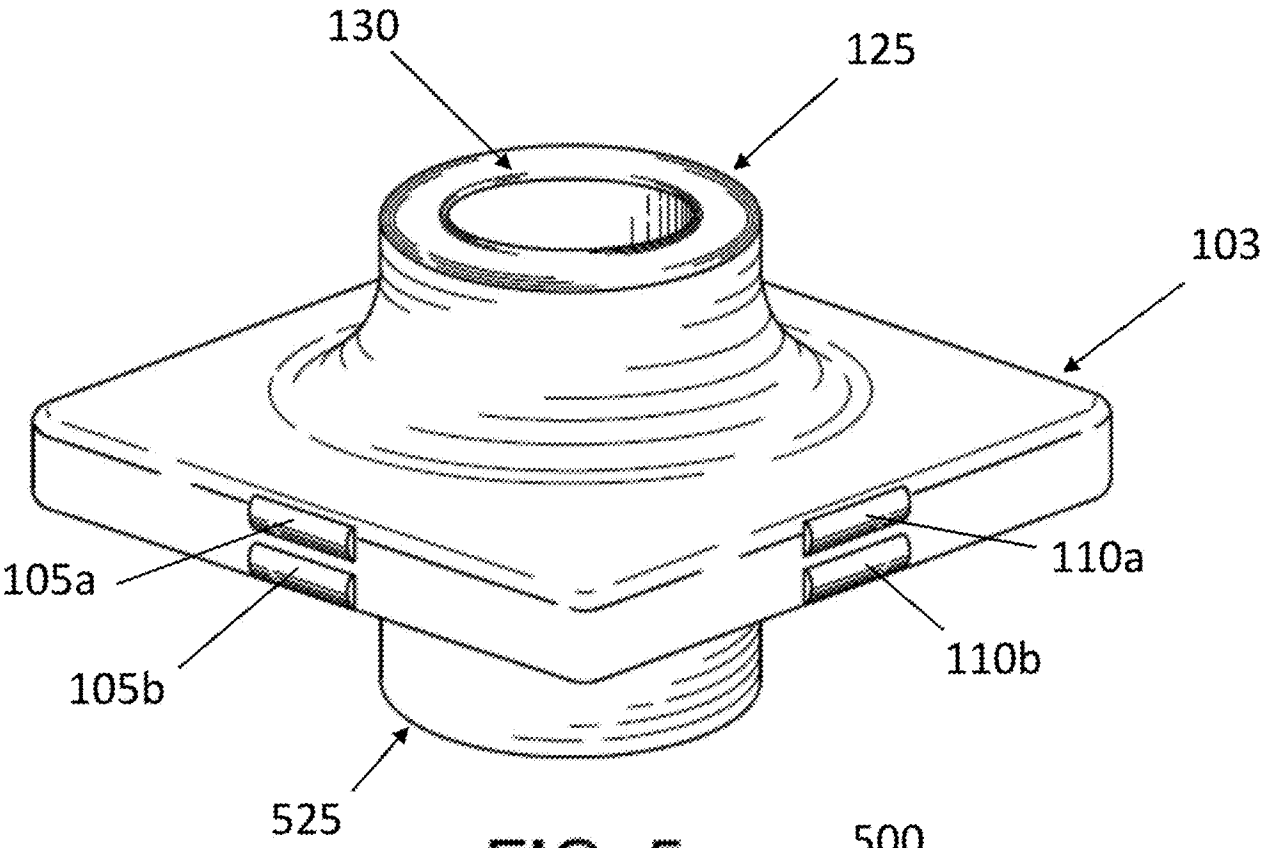
FIGS. 5-8 are illustrations of a second embodiment of a base member for use with the disclosed system and method.
Figure 6:
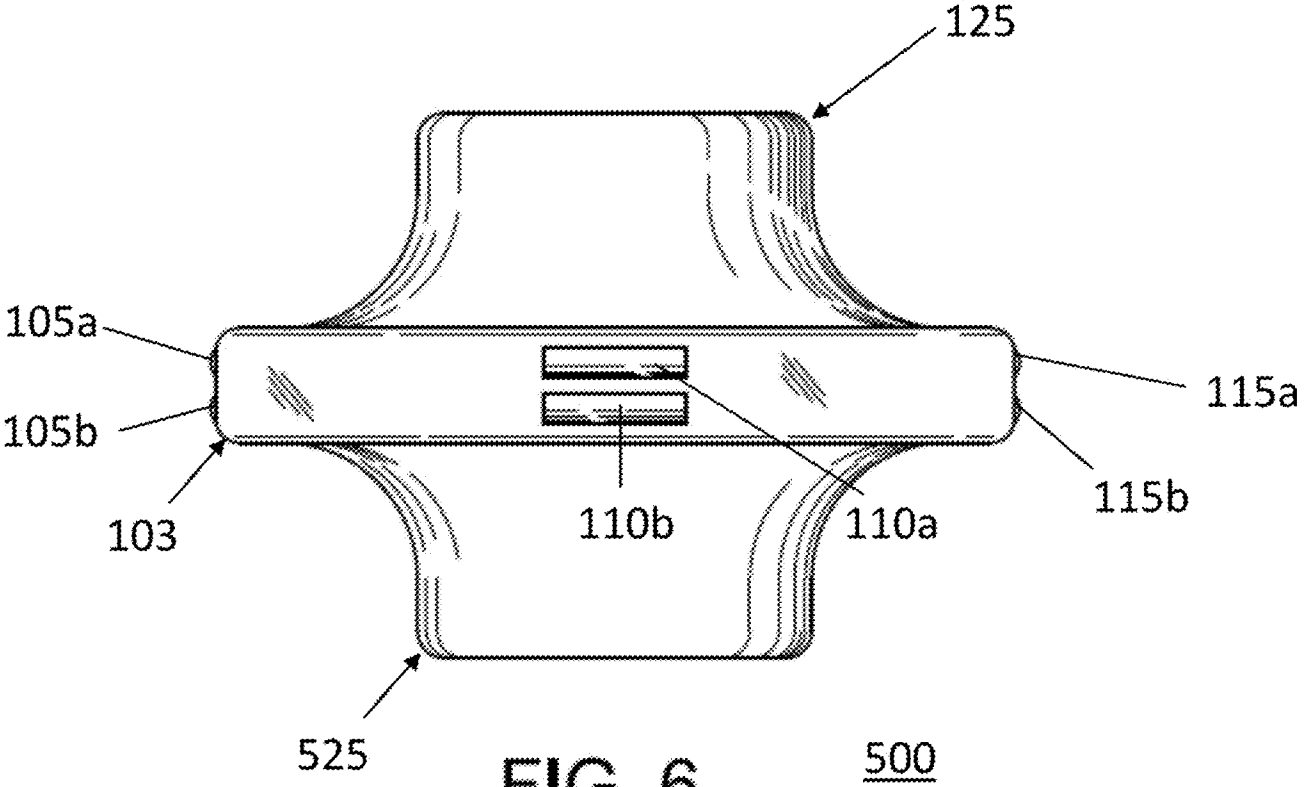
Figure 7:
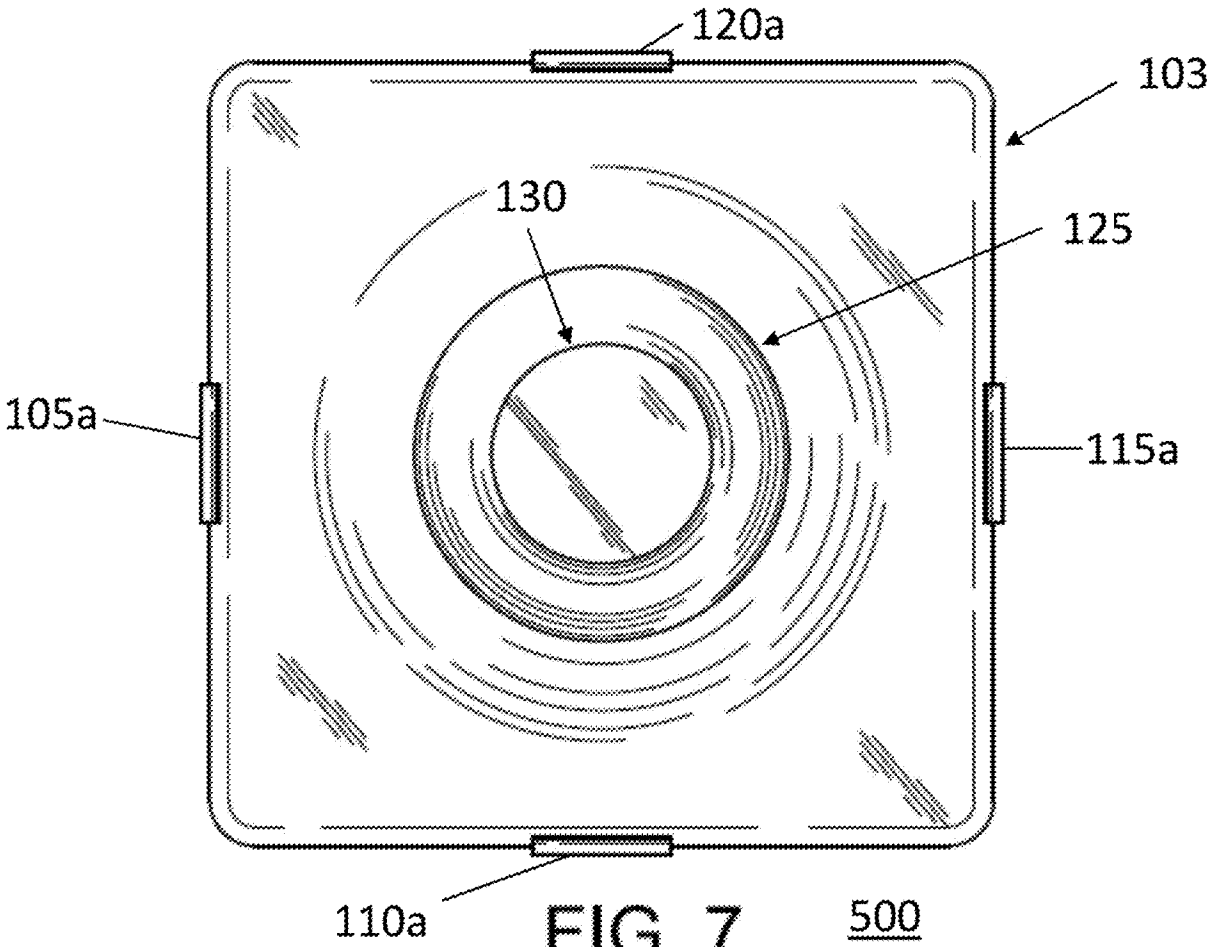
Figure 8:
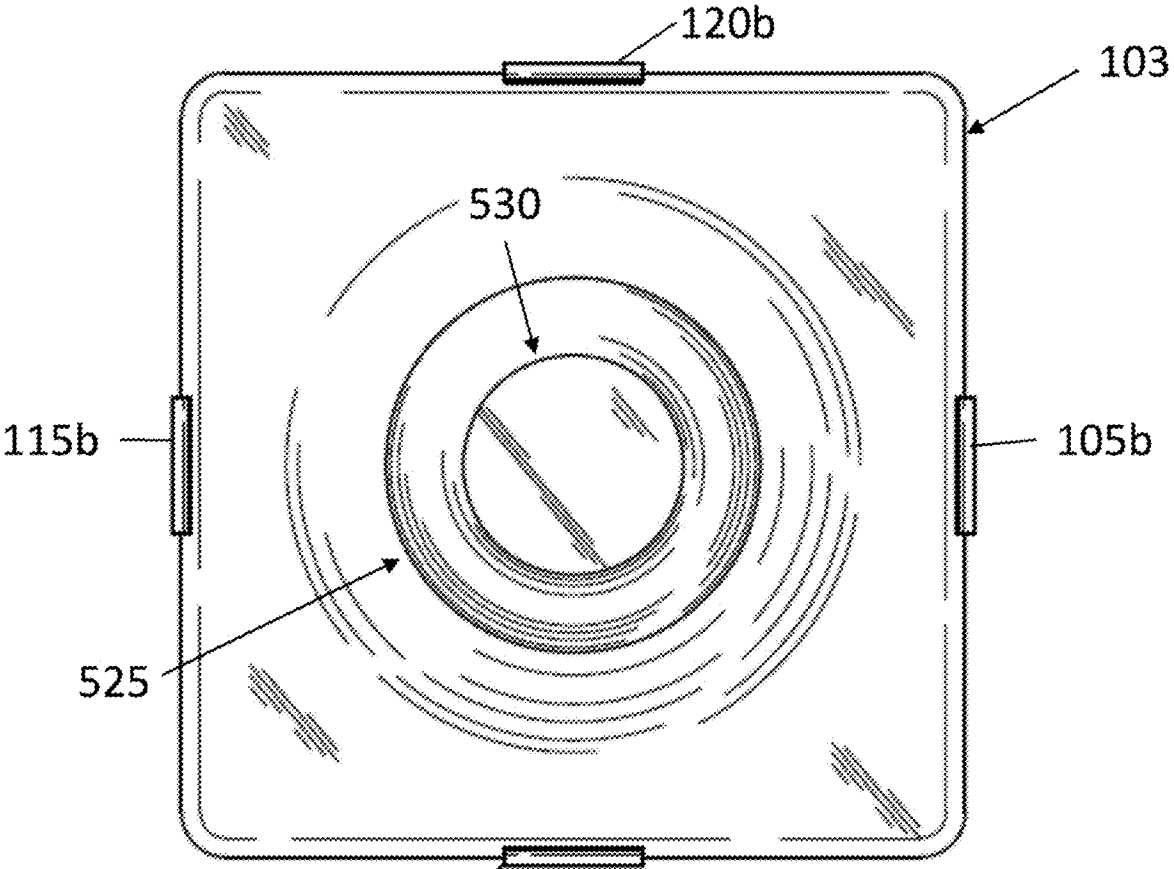

Shown in FIGS. 5-8 is another embodiment of a base member 500 of the present invention. FIG. 5 is a perspective view, FIG. 6 is a front view, FIG. 7 is a top view, and FIG. 8 is a bottom view of a base member 500 according to an exemplary embodiment of the present invention. In FIGS. 5-8, like elements are referred to with the same reference numerals as those used in FIGS. 1-4 and detailed descriptions of which will not be repeated. In this embodiment, as shown in FIGS. 5-6 and 8, there are two (2) volcano-shaped projections 125 and 525 extending from both (opposite) faces of the tile portion 103, with respective central openings 130 and 530 for receiving connector elements that can be used to connect multiple magnetic tiles together. As shown in FIGS. 5-8, projections 125 and 525 are aligned with each other, and openings 130 and 530 are, likewise, aligned with each other in sharing a common central axis. This particular base member 500 can be used as an intermediary for connecting multiple tiles together.

Shown in FIGS. 10-15 are various embodiments of connectors of the present invention. Such connectors are sized to fit snuggly (e.g., by a friction or interference fit) within the volcano-shaped projections of a base member (e.g., openings 130 and 530 in projections 125 and 525 of base members 100 and 500, respectively, as shown in FIGS. 1-8). Alternatively, the connectors can be configured to connect with the base members by a snap-fit, taper-fit, screw-fit, or other known mechanical fastening systems and methods. In embodiments, the connectors may be made from a rigid, semi-resilient, or resilient (e.g., polymeric) material.

Figure 10:
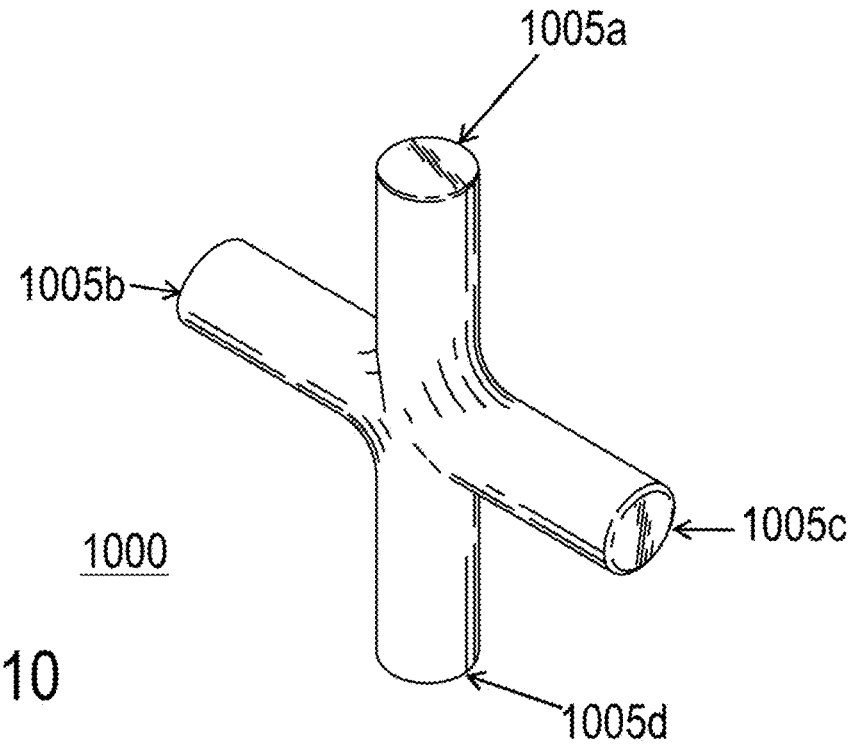
FIGS. 10-15 are illustrations of various embodiments of the connectors for use with the disclosed system and method.
Figure 11:
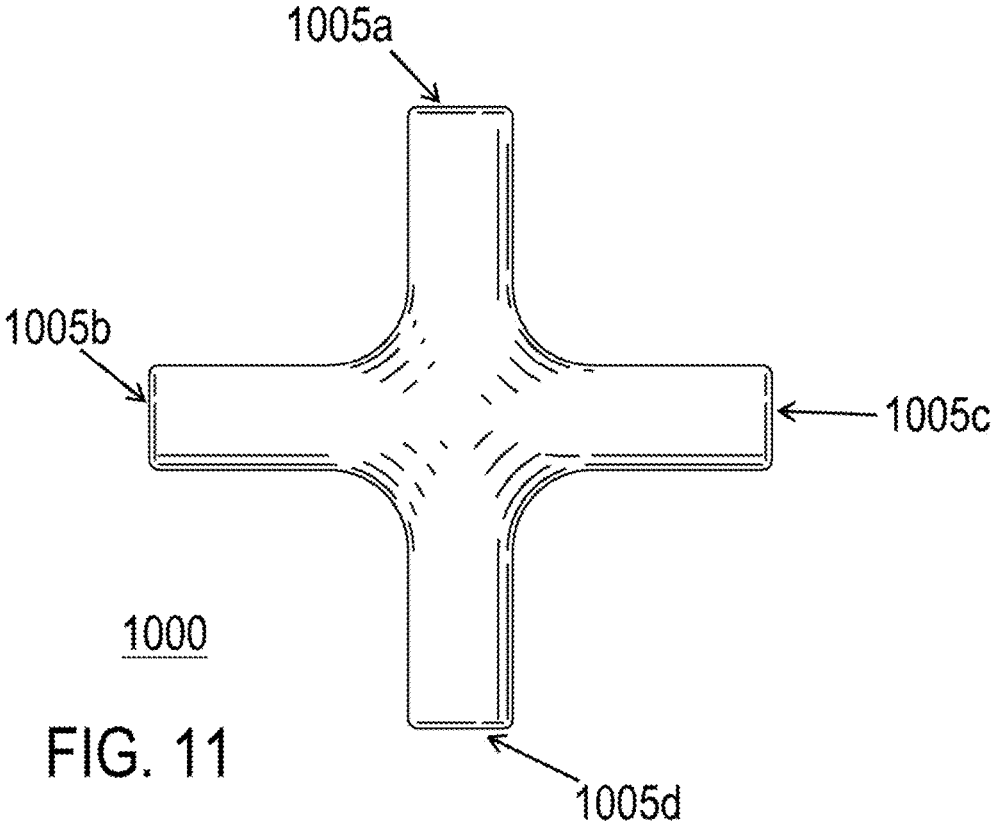

FIG. 10 is a perspective view and FIG. 11 is a front view of a cross-shaped connector 1000 having four (4) ends 1005*a*, 1005*b*, 1005*c*, and 1005*d* that are dimensioned for insertion (i.e., insertable) into openings 130 and 530 of base members 100 and 500 according to an exemplary embodiment of the present invention. As illustrated in FIG. 10, ends 1005*a*, 1005*b*, 1005*c*, and 1005*d* have a substantially circular cross-section that corresponds with the substantially circular openings 130 and 530. In addition, ends 1005*a*, 1005*b*, 1005*c*, and 1005*d* are at approximately right angles from one another on a common plane for connecting four (4) magnetic tiles incorporating base members 100 or 500 to form a cube-shaped enclosure around connector 1000—see, for example, cube 2010 that forms part of the wheeled chassis of vehicle 2000 shown in FIG. 20; and see, for example, the top of column 2100 shown in FIG. 21.

Figure 12:
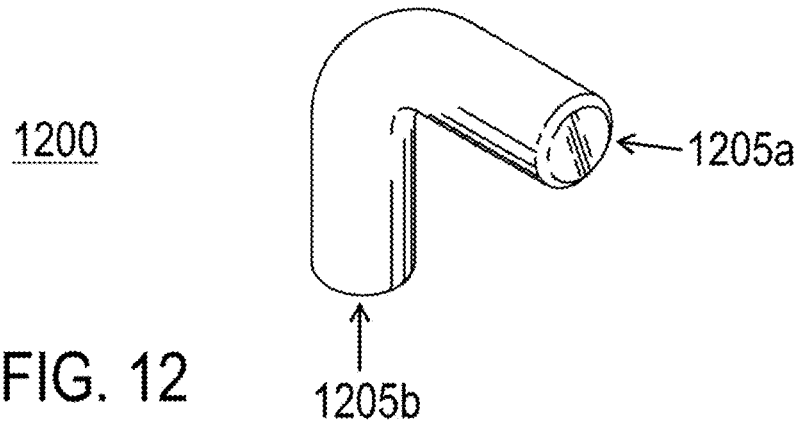
Figure 13:
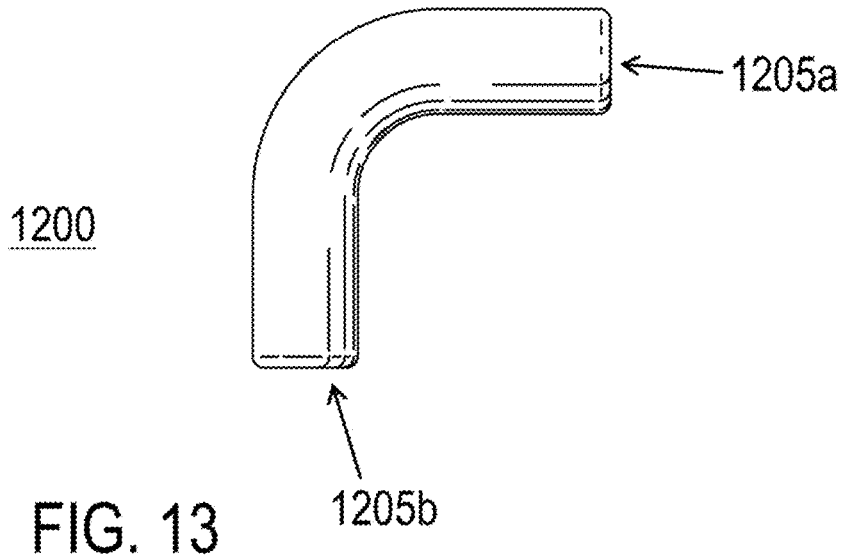

FIG. 12 is a perspective view and FIG. 13 is a front view of a bent connector 1200 having two (2) ends 1205*a* and 1205*b* that are dimensioned for insertion into openings 130 and 530 of base members 100 and 500 according to an exemplary embodiment of the present invention. As illustrated in FIG. 13, ends 1205*a* and 1205*b* have a substantially circular cross-section that corresponds with the substantially circular openings 130 and 530. In addition, ends 1205*a* and 1205*b* are at approximately a right angle from each other on a common plane for connecting two (2) base members 100 or 500 to form walls (embodied by magnetic tiles incorporating base members 100/500) that are at approximately a right angle from each other.

Figure 14:
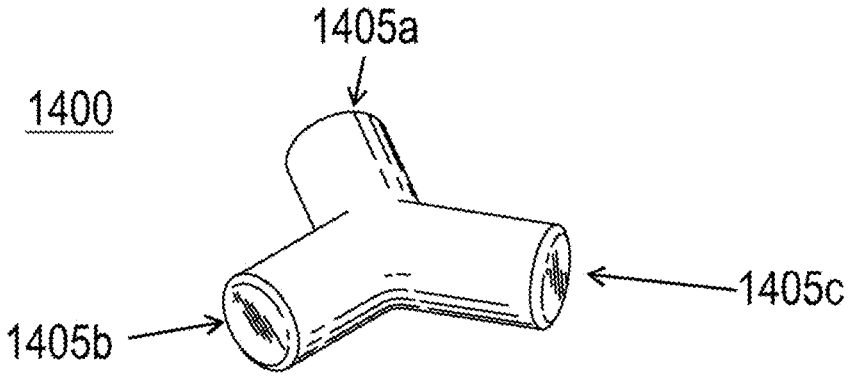
Figure 15:
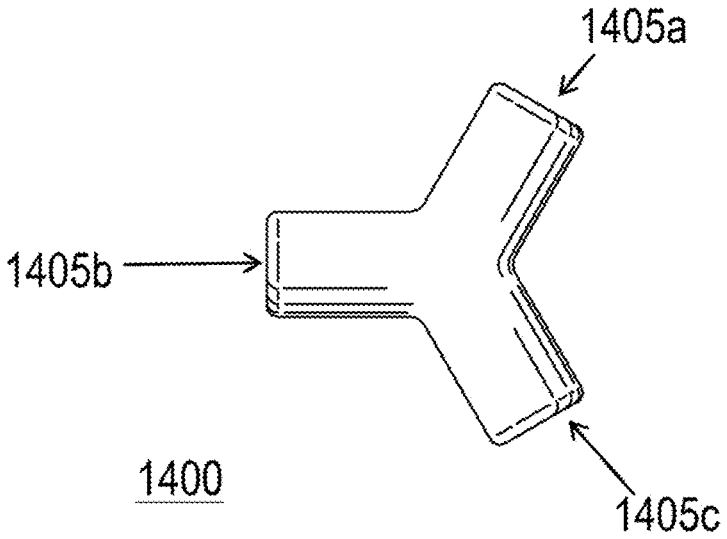

FIG. 14 is a perspective view and FIG. 15 is a front view of a Y-shaped connector 1400 having three (3) ends 1405*a*, 1405*b*, and 1405*c* that are dimensioned for insertion into openings 130 and 530 of base members 100 and 500 according to an exemplary embodiment of the present invention. As illustrated in FIG. 15, ends 1405*a*, 1405*b*, and 1405*c* have a substantially circular cross-section that corresponds with the substantially circular openings 130 and 530. In addition, ends 1405*a*, 1405*b*, and 1405*c* are at approximately one-hundred-and-twenty-degree (120°) angles from one another on a common plane for connecting three (3) magnetic tiles incorporating base members 100 or 500 to form a triangular-prism-shaped enclosure around connector 1400—see, for example, prism 2014 shown in FIG. 20.

Figure 16:
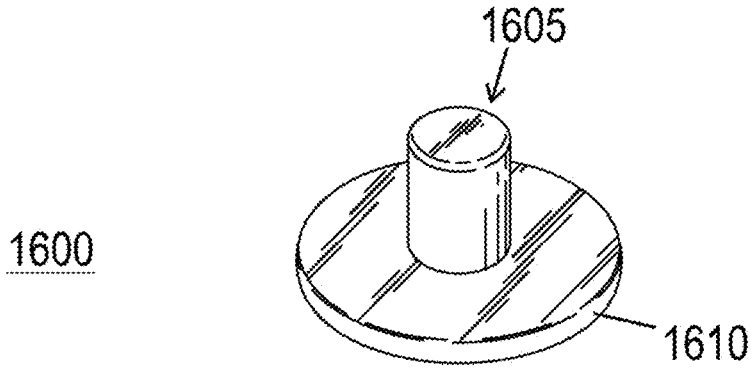
FIGS. 16-17 are illustrations of a bearing for use with the disclosed system and method.
Figure 17:
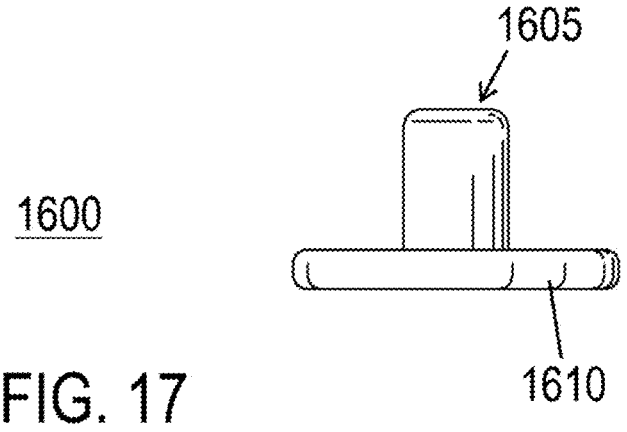

Shown in FIGS. 16-17 is one embodiment of a bearing 1600 that can be used with the present invention. Such bearings, for example, can be used to join wheels (shown in FIGS. 18-19) to a base member, or anywhere a rotatable connection is desired. FIG. 16 is a perspective view and FIG. 17 is a front view of bearing 1600 having an end 1605 that is dimensioned for insertion into opening 130 or 530 of base members 100 and 500 according to an exemplary embodiment of the present invention. As illustrated in FIG. 17, end 1605 has a substantially circular cross-section that corresponds with the substantially circular openings 130 and 530. As further shown in FIG. 16, bearing 1600 includes a disc-shaped base 1610 that serves as a backstop for fastening a wheel (e.g., wheel 1800 shown in FIGS. 18-19), or the like, in a rotatable fashion to a magnetic tile incorporating a base member 100 or 500.

Figure 18:
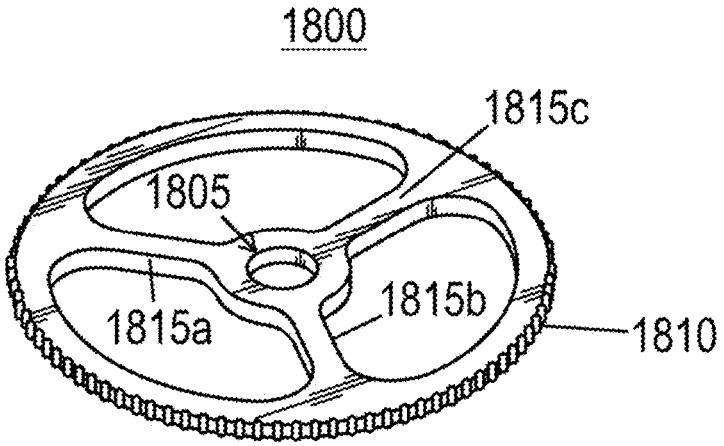
FIGS. 18-19 are illustrations of a wheel for use with the disclosed system and method.
Figure 19:
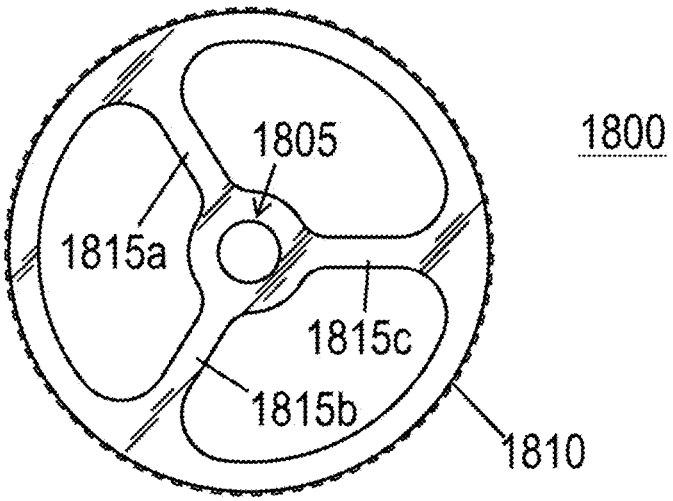

FIG. 18 is a front view and FIG. 19 is a perspective view of wheel 1800 having an opening 1805 that is dimensioned for receiving, for example, end 1605 of bearing 1600 that can, in turn, be inserted into opening 130 or 530 of base members 100 and 500 according to an exemplary embodiment of the present invention. When fastened to base member 100 or 500, wheel 1800 may be rotatable at bearing 1600. As shown in FIGS. 18 and 19, opening 1805 is connected to the circumference 1810 of wheel 1800 through the support of three (3) spokes 1815*a*, 1815*b*, and 1815*c*. In embodiments, wheel 1800 may incorporate a different number of spokes and/or a different circumference.

Figure 20:
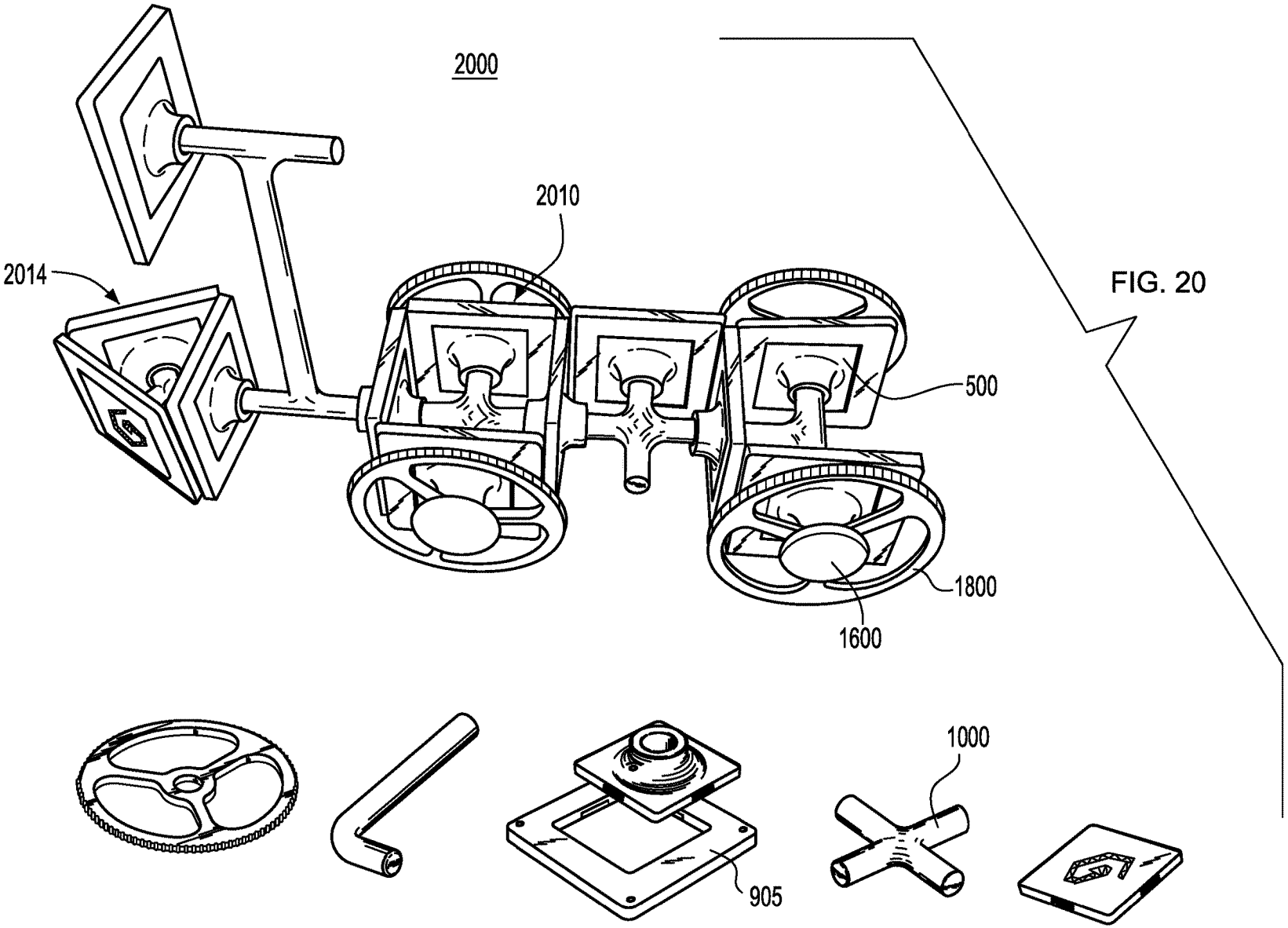
FIGS. 20-22 are photographs demonstrating how the above base members and connectors can be used in accordance with the disclosed system and method.
Figure 21:
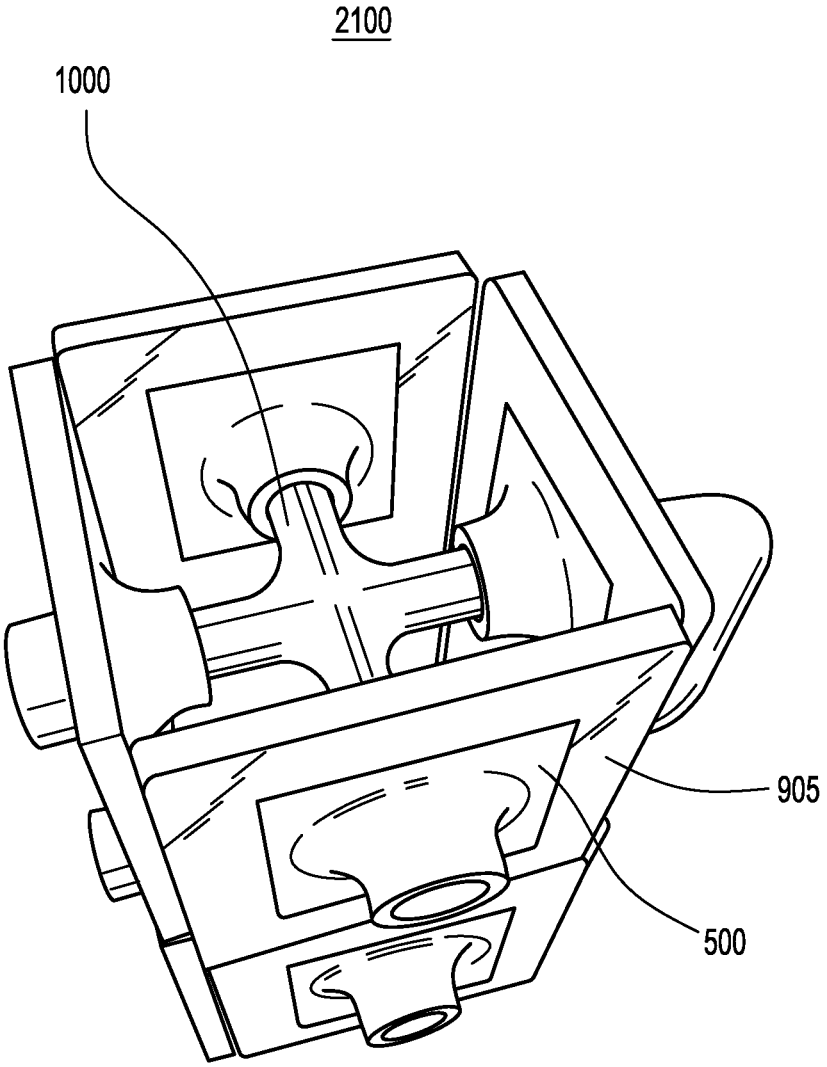
Figure 22:
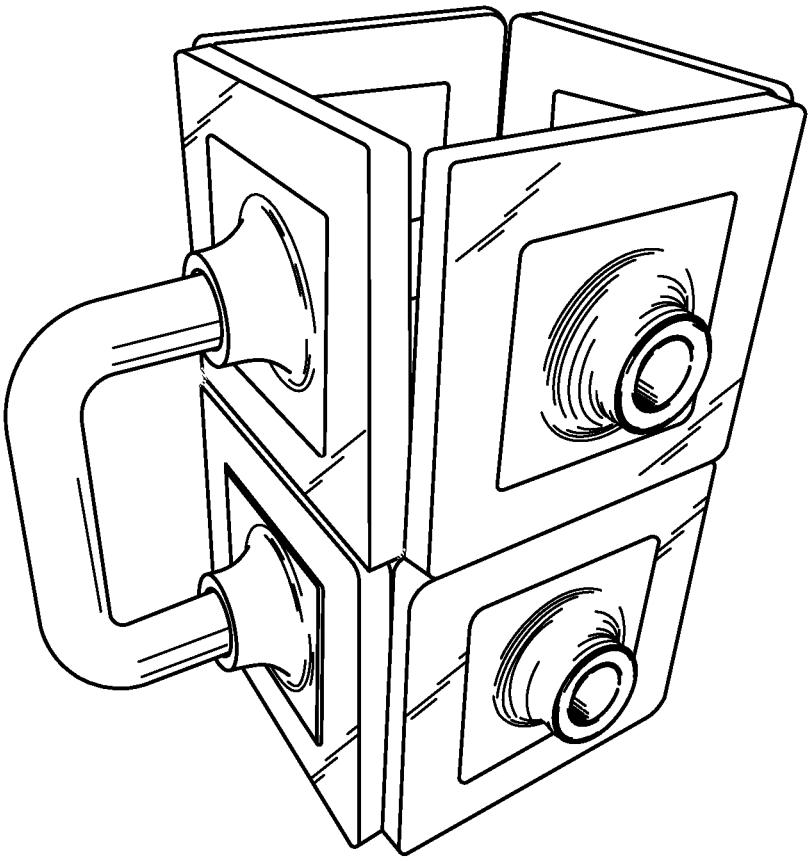

FIGS. 20-22 are photographs of projects constructed using the disclosed building system. For example, FIG. 20 shows the construction of a wheeled vehicle 2000 constructed using the disclosed building system. As shown, double-sided base members (500) are inserted into magnetic window tiles and used, in combination with four-way connectors (1000), to construct the chassis of the vehicle 2000. Wheels (1800) are attached to the chassis using bearings (1600). FIGS. 21-22 are photographs of a small tower (column 2100) constructed using the disclosed building system.

Figure 23:
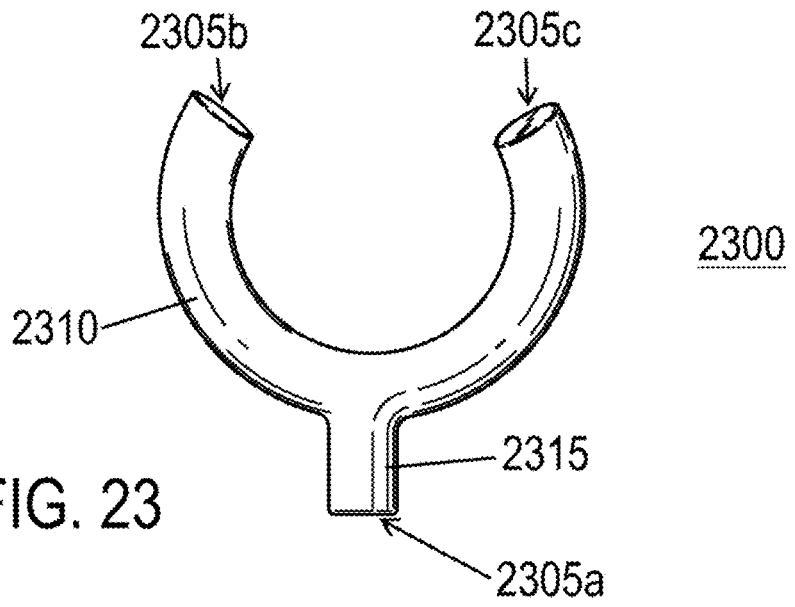
FIGS. 23 and 24 are diagrams illustrating a connector for use with the base members of FIGS. 1-8 according to an exemplary embodiment of the present invention.
Figure 24:
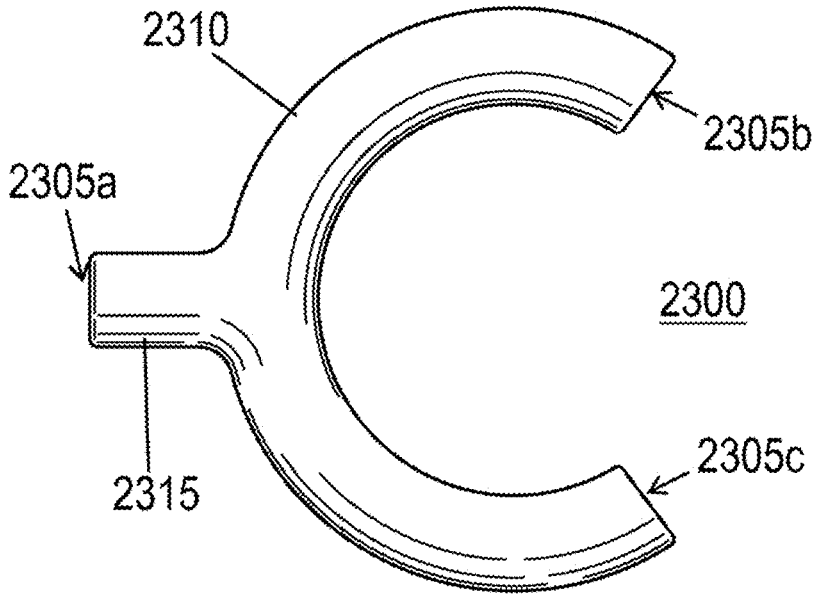

FIG. 23 is a front perspective view and FIG. 24 is a front view of another Y-shaped connector 2300 having three (3) ends 2305*a*, 2305*b*, and 2305*c* that are dimensioned for insertion into openings 130 and 530 of base members 100 and 500 according to an exemplary embodiment of the present invention. Correspondingly, each of ends 2305*a*, 2305*b*, and 2305*c* have a substantially circular cross-section that corresponds with the substantially circular openings 130 and 530. As further illustrated in FIG. 23, connector 2300 includes a circular section 2310 that connects ends 2305*b* and 2305*c* to each other and to a straight stem section 2315 that connects to end 2305*a*. Accordingly, ends 2305*a*, 2305*b*, and 2305*c* are on a common plane for connecting three (3) magnetic tiles incorporating base members 100 or 500 to form a Y-shaped arrangement around connector 2300.

Figure 25:
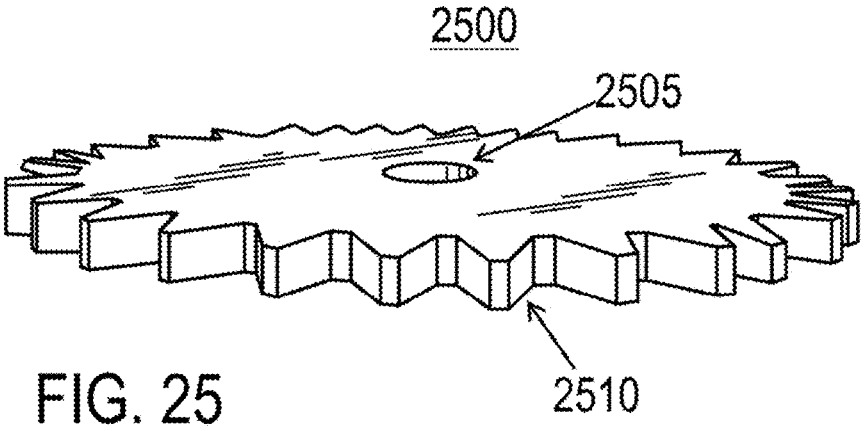
FIGS. 25 and 26 are diagrams illustrating a gear member for use with the base members of FIGS. 1-8 according to an exemplary embodiment of the present invention.
Figure 26:
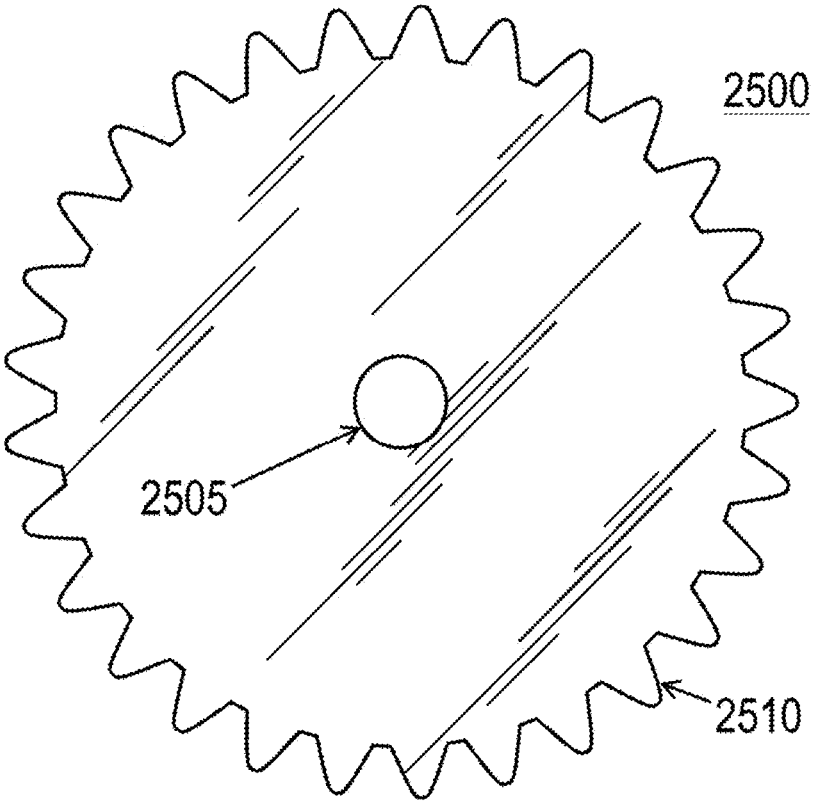
Figure 27:
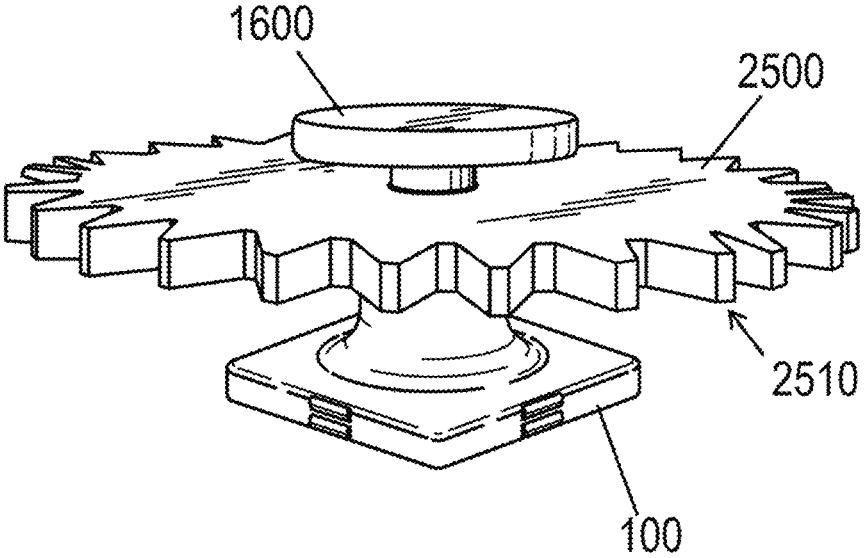
FIG. 27 is a diagram showing the gear member of FIGS. 25 and 26 being incorporated with a base member using a bearing of FIGS. 16 and 17 according to an exemplary embodiment of the present invention.

FIG. 25 is a perspective view and FIG. 26 is a front view of gear 2500 having an opening 2505 that is dimensioned for receiving, for example, end 1605 of bearing 1600 that can, in turn, be inserted into opening 130 of base member 100, as illustrated in FIG. 27, according to an exemplary embodiment of the present invention. When fastened to base member 100, as shown in FIG. 27, or base member 500, gear 2500 may be rotatable at bearing 1600. As shown in FIGS. 25-27, gear 2500 incorporates gear teeth 2510 around its circumference, which may engage another gear (not shown) mounted on another base member 100/500 having the same or different number of gear teeth and/or a same or different circumference.

Figure 28:
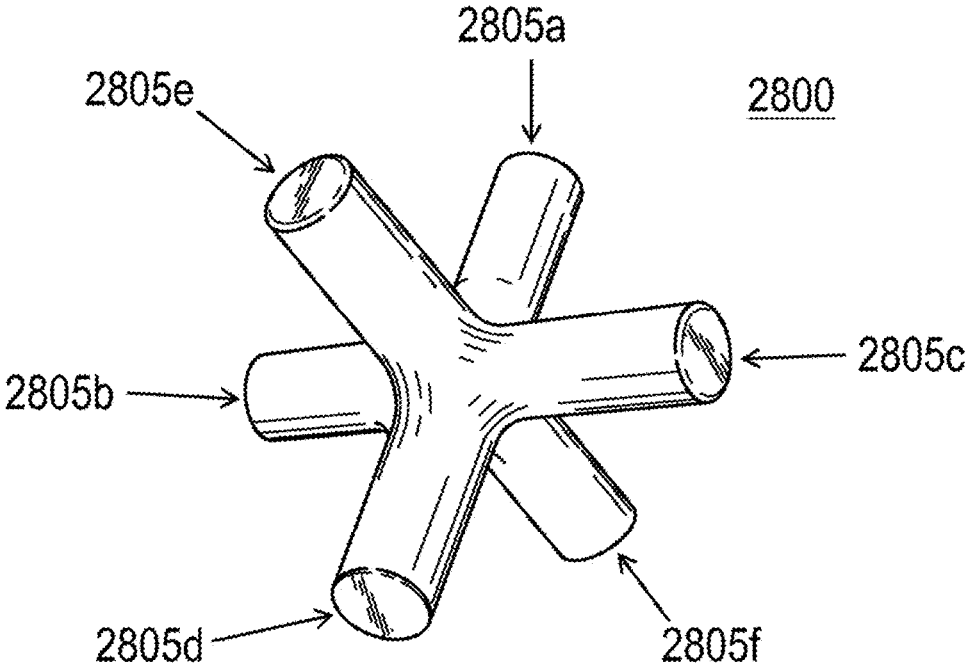
FIGS. 28 and 29 are diagrams illustrating a connector for use with the base members of FIGS. 1-8 according to an exemplary embodiment of the present invention.
Figure 29:
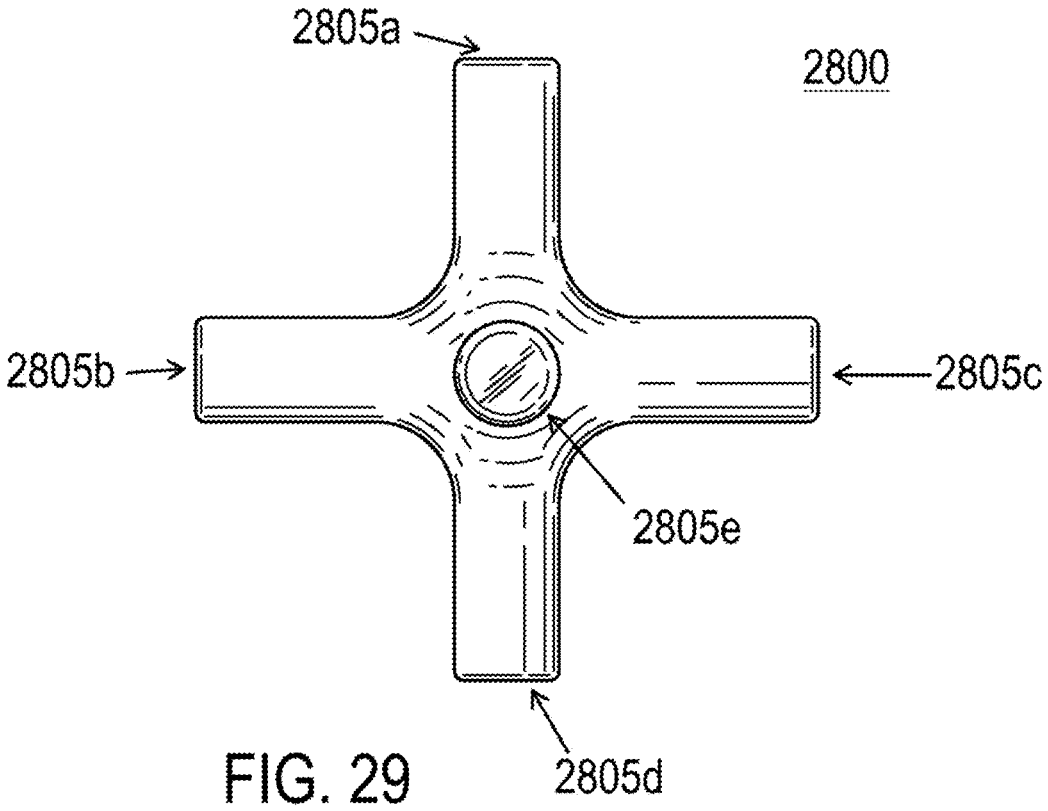

FIG. 28 is a perspective view and FIG. 29 is a front view of a three-dimensional cross-shaped connector 2800 having six (6) ends 2805*a*, 2805*b*, 2805*c*, 2805*d*, 2805*e*, and 2805*f* that are dimensioned for insertion (i.e., insertable) into openings 130 and 530 of base members 100 and 500 according to an exemplary embodiment of the present invention. As illustrated in FIG. 28, ends 2805*a*, 2805*b*, 2805*c*, 2805*d*, 2805*e*, and 2805*f* have a substantially circular cross-section that corresponds with the substantially circular openings 130 and 530. As further shown in FIGS. 28 and 29, connector 2800 is similar to connector 1000, with four (4) of its ends 2805*a*, 2805*b*, 2805*c*, and 2805*d* that are at approximately right angles from one another on a common plane for connecting four (4) magnetic tiles incorporating base members 100 or 500 to form a cube-shaped enclosure around connector 2800—see, for example, cube 2010 that forms part of the wheeled chassis of vehicle 2000 shown in FIG. 20; and see, for example, the top of column 2100 shown in FIG. 21. In addition, connector 2800 further includes front and back ends 2805*e* and 2805*f* (or top and bottom ends in the views of FIGS. 20-22) that are at approximately right angles from the common plane of the other four (4) ends 2805*a*, 2805*b*, 2805*c*, and 2805*d*, and that provide for connecting additional front and back (or top and bottom in the views of FIGS. 20-22) magnetic tiles to form a fully enclosed cube.

The disclosed system and method provide substantially increased structural rigidity, as compared to magnetic tiles alone. This system and method allows users of magnetic building systems to create durable and unique projects that would otherwise be impossible using magnetic building tiles alone.

The invention claimed is:

1. A base member configured for use with a windowed magnetic tile, the base member comprising:

a tile portion having three or more outer edges configured with respective protrusions for fitting engagement with respective notches on corresponding three or more inner edges of the windowed magnetic tile;

a first projection extending outwardly from a first surface of the tile portion formed by the three or more outer edges; and a first opening disposed on the first projection;

a connector inserted into the first opening;

a wheel having a first opening through which the connector is inserted into the first opening of the base member; and wherein the connector is a bearing that comprises a disc-shaped portion.

2. The base member of claim 1, further comprising:

a second projection extending outwardly from a second surface of the tile portion formed by the three or more outer edges; and a second opening disposed on the second projection, wherein the second surface is on an opposite side from the first surface of the tile portion.

3. The base member of claim 1, wherein the connector comprises a plurality of ends that are insertable to the first opening.

4. The base member of claim 3, wherein the plurality of ends are at a right angle from one another on a common plane.

5. The base member of claim 4, wherein the connector comprises four ends to form a cross shape.

6. The base member of claim 3, wherein the plurality of ends are at a 120 degree angle from one another on a common plane.

7. The base member of claim 1, wherein the tile portion is a square-shaped tile portion for fitting to a square-shaped opening in the windowed magnetic tile.

* * * * *